US006280574B1

(12) United States Patent
Bauer

(10) Patent No.: US 6,280,574 B1
(45) Date of Patent: Aug. 28, 2001

(54) MOISTURE APPLICATION SYSTEM FOR A PAPER WEB

(75) Inventor: Donald G. Bauer, Laurel, MD (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/296,394

(22) Filed: Apr. 23, 1999

(51) Int. Cl.[7] ..... D21G 9/00

(52) U.S. Cl. ..... 162/206; 100/74; 118/126; 162/266; 162/361; 427/356; 427/365

(58) Field of Search ..... 162/136, 206, 162/361, 265, 266; 427/356, 365; 118/126; 100/74, 75, 35

(56) References Cited

U.S. PATENT DOCUMENTS

| | | | | |
|---|---|---|---|---|
| 287,500 | * | 10/1883 | Boyne, Jr. | 100/75 |
| 1,864,852 | * | 6/1932 | Oblinger | 162/206 |
| 2,130,530 | | 9/1938 | Fletcher | 91/70 |
| 3,948,721 | | 4/1976 | Winheim | 162/207 |
| 4,712,506 | * | 12/1987 | Rantanen et al. | 118/126 |
| 4,973,441 | * | 11/1990 | Keller | 162/361 |
| 5,286,526 | * | 2/1994 | Rantanen et al. | 118/126 |
| 5,378,497 | * | 1/1995 | Johnson et al. | 427/365 |
| 5,522,312 | | 6/1996 | Johnson | 100/74 |
| 5,607,553 | | 3/1997 | Chadha | 162/205 |
| 5,681,618 | * | 10/1997 | Damrau et al. | 427/365 |

OTHER PUBLICATIONS

"Practical Aspects of Calender Steam Showers", by R. N. Vyse and David J. Sawley, Oct. 1998, TAPPI Journal, pp. 87–90.

* cited by examiner

*Primary Examiner*—Karen M. Hastings

(57) ABSTRACT

The moisture application system of the present invention comprises in combination a first means for applying liquid to a paper web and a second means in contact with the web for scraping off excess liquid and spreading the liquid uniformly across the paper web. The moisture application system of the present invention is particularly useful when combined with a machine calender for finishing a paper web.

14 Claims, 2 Drawing Sheets

MOISTURE APPLICATION SYSTEM FOR A PAPER WEB

BACKGROUND OF INVENTION

The present invention relates generally to a moisture application system for adding moisture to a web of paper, paperboard or the like for curl control, or to improve the performance of the paper for a particular end use application, or for improved finishing during a calendering operation. In its most practical sense, the present invention relates to a method and apparatus for the finishing of paper and paperboard, and more particularly to an improvement to a calender device normally used to provide enhanced smoothness and gloss to such products.

It is common practice in the paper industry to add moisture to paper webs during the manufacturing process as shown for example in U.S. Pat. No. 3,948,721. It is also known, for example, as shown in U.S. Pat. No. 2,130,530, to add moisture to a paper web in the finishing step at the machine calender during the papermaking process. This moisture application may take many different forms, but it is most commonly carried out by waterbox calendering. However, the use of a waterbox calender to impart a smooth surface to bleached paperboard, or a similar substrate, has an inherent problem, namely, a lack of control of the amount of liquid picked up by the substrate in the calender nip. During conventional waterbox calendering, the amount of liquid supplied to the calender nip is such that the nip is flooded. Thus, the quantity of liquid picked up is determined by the diameter of the calender rolls, operating speeds, nip pressures, and substrate characteristics (e.g., thickness, sizing level and roughness). Accordingly, the application of moisture to a paper substrate using a waterbox generally results in the transfer of an amount of liquid far in excess of what is required to achieve the desired smoothness. The excess liquid weakens the substrate resulting in web breaks, and tends to establish a lower basis weight limit for production using a waterbox. For some applications, penetration of the excess water into the substrate also results in an undesirable reduction in the caliper or thickness of the web. Thus there is a need to provide a means for applying moisture to a paper web during the calendering process that is independent of the speed of the calender. There is also a need to provide a means that introduces only as much moisture as is required to achieve the desired finished properties of the web without unduly influencing the thickness of the web.

Other methods for adding moisture to a paper web at the machine calender include the application of steam or water sprays to the web. The application of steam onto a web to increase its water content is possible, but it requires that the web be cooled for efficient condensation of the steam into the form of water droplets. An article entitled "Practical Aspects of Calender Steam Showers", by R. N. Vyse and David J. Savly, October 1998 TAPPI Journal, pp. 87–90, discloses the treatment of a paper web with steam before calendering. Spraying liquid directly onto a web is another method for increasing moisture content at the machine calender. However, water spray systems generally have limitations, primarily due to a lack of uniformity of application, and the production of wet streaks caused by an overlap of sprays from adjacent nozzles, which results in nonuniform smoothness and caliper profiles. These problems have been overcome to some extent with the application of moisture directly onto one of the rolls of a calender using a brush-spray device just prior to the point where the roll contacts the web, substantially as disclosed in U.S. Pat. No. 5,607,553, assigned to the present assignee herein. Likewise, moisture may also be added to a paper web at the machine calender by applying a metered film of liquid directly onto a calender roll as shown, for example, in U.S. Pat. No. 5,522,312, also assigned to the present assignee herein. The latter patent discloses an apparatus for adding small quantities of moisture to a paper web by mounting a metering element on the waterbox which meters excess liquid off the calender roll prior to the liquid transfer nip. While this apparatus and method has its merits, it has not been found to be completely successful in practice. Accordingly, while the use of a waterbox is generally agreed to be the preferred method for adding moisture to a paper web at a machine calender, the problems inherent with conventional waterbox calendering have yet to be solved. Thus it may be seen that a solution to these problems is desirable, and the solution proposed by the method and apparatus described herein represents a novel effort toward that end.

SUMMARY OF INVENTION

According to the present invention, a conventional waterbox calender is improved upon by substituting for the waterbox a moisture application system for precise control of the amount of liquid added to the paper web. The moisture application system comprises a source for introducing liquid onto the web and a metering device for scraping off excess liquid and assuring a uniform application. In this regard, the liquid metering device functions much like a coater or size press used to apply liquid compositions to a paper web since, in the present invention, the liquid is applied directly to the web or into the space between the web and the metering device and the metering device wipes excess liquid off the web before the web enters the nip between two calender rolls. By controlling the amount of liquid applied to the web in a lineal direction, and the uniformity of the applied liquid in the cross direction, the liquid application can be minimized for optimum performance. It is possible with the present invention to control the location and depth of penetration of the liquid into the substrate, and thereby reduce caliper losses during calendering, while still achieving optimum smoothness.

Metering of the applied liquid from the web can be achieved with the use of a blade or a rotatable or fixed metal or ceramic coated rod or bar. When using a blade metering or wiping element, the amount of liquid which penetrates the web is initially reduced when the blade element is moved into operating position in contact with the web. Upon increasing the pressure applied to the blade, the blade becomes bent to vary the amount of liquid picked up by the web. The liquid metering device and liquid application means are each preferably adjustable independently of the speed of the calender and the load applied to the substrate in the calender nips.

The device of the present invention may be used in any calendering operation where a smooth surface is required with a minimum loss of caliper, including, but not limited to, the manufacture of bleached paper and paperboard, unbleached paper and paperboard, saturating kraft, or other like materials.

It is also contemplated that for some applications, separate metering devices could be arranged, one on each side of the calender stack, to apply moisture to each side of the web. The method for introducing the liquid to the web is not a subject of this invention since it is believed that any desired method might be chosen, including sprays, jets, tubes, slots, etc., arranged across the web, depending upon the configuration of the calender.

DESCRIPTION OF DRAWING

The invention will be better understood by reference to the accompanying drawings.

DETAILED DESCRIPTION

Figure 1:
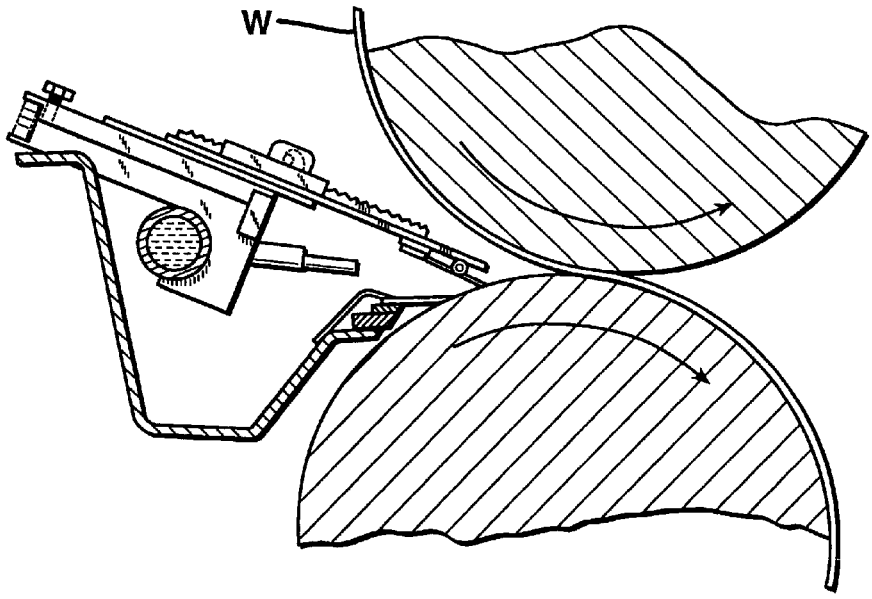
FIG. 1 PRIOR ART
FIG. 1 is a side elevational view of a liquid metering system for applying water to a calender roll according to U.S. Pat. No. 5,522,312.
Figure 2:
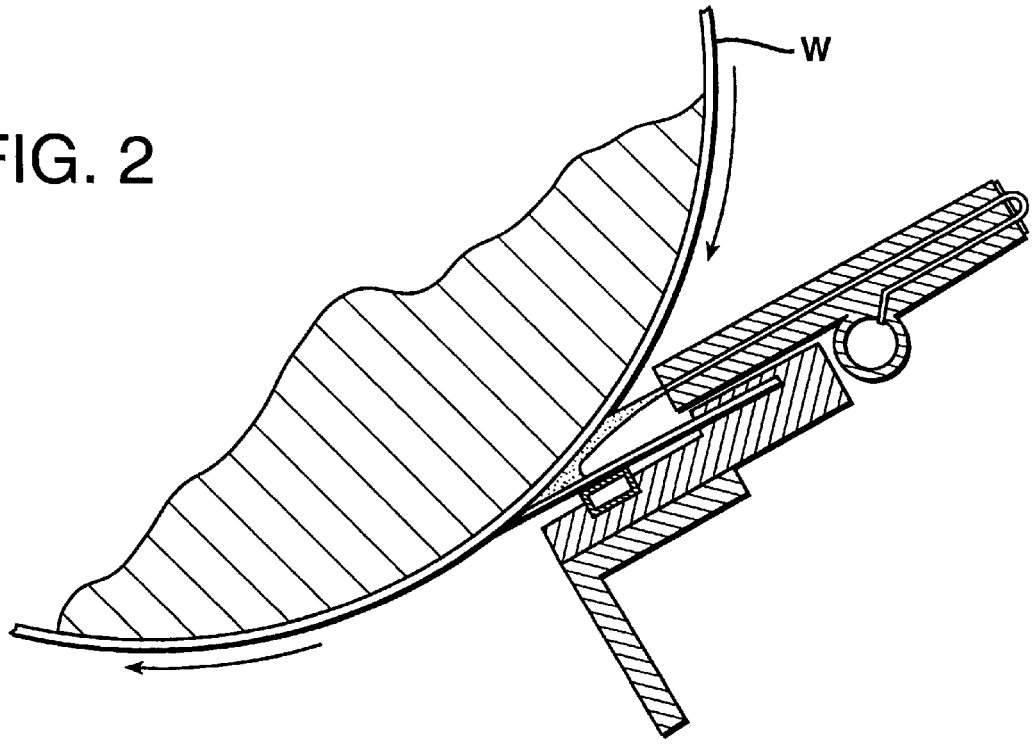
FIG. 2 is a side elevational view of the liquid metering system of the present invention for applying water to the web; and, FIG. 3 is a schematic view showing a typical machine calender device incorporating a moisture application system according to the present invention.
Figure 3:
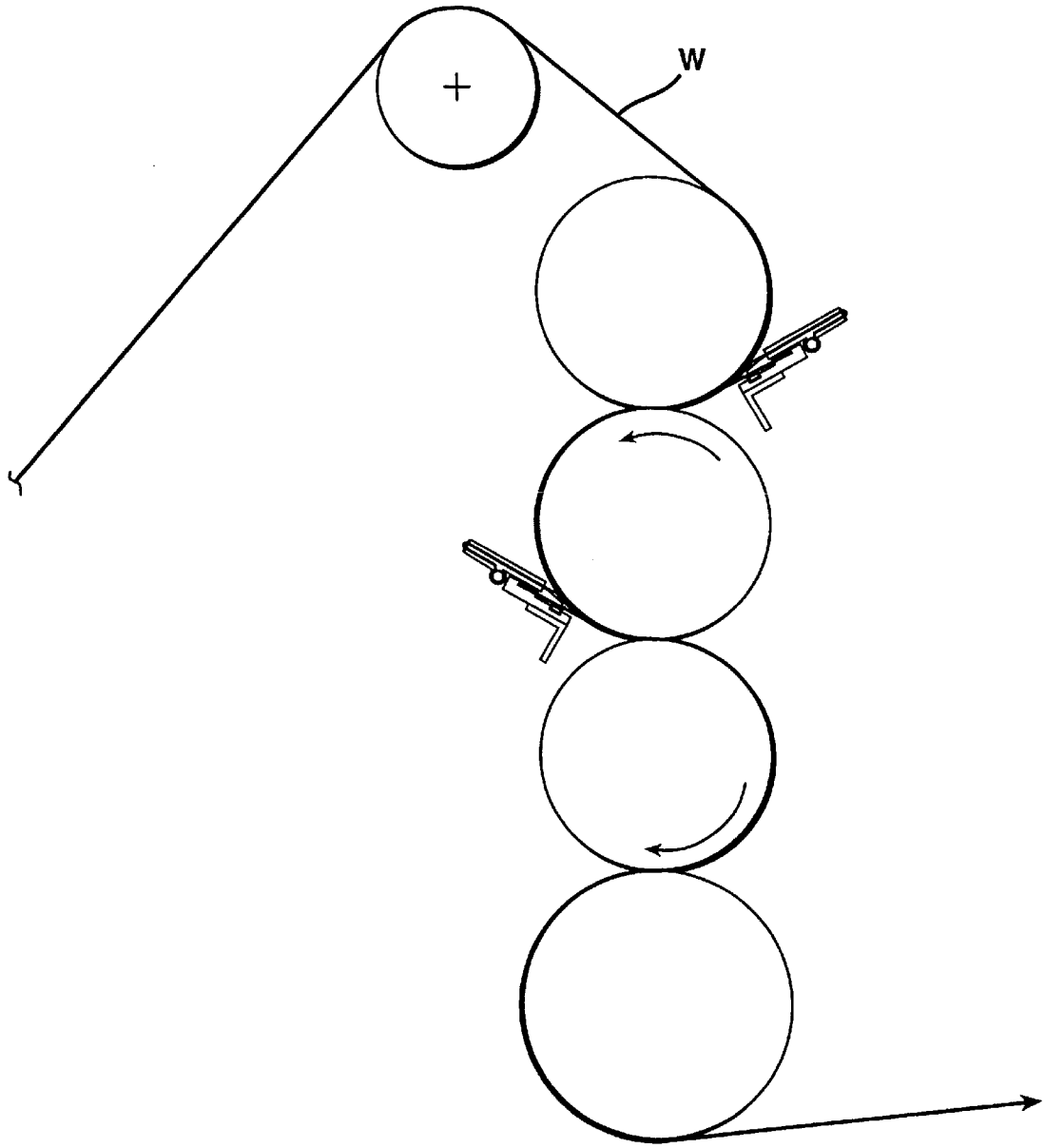

The improvement set forth in the present invention comprises the addition of a liquid application means capable of applying a uniform application of liquid, controllably across the width of a paper web and an adjustable metering device for spreading the liquid across the web and wiping excess liquid from the web before it enters a calender nip.

Liquid application means suitable for use according to the present invention include an array of capillary tubes, spray nozzles, or other means capable of delivering a controllable and uniform fluid flow. Sufficient fluid is necessary to cover the entire width of the web. Metering devices suitable for the present invention include a blade, bar, rod or roll that can be loaded to doctor off excess liquid without damaging the web surface. In laboratory experiments using water with a bleached paperboard web at 1200 ft/minute, a flooded nip like that encountered in a typical waterbox added 8–10 lbs/ream of moisture to the web while the blade metered method of the present invention resulted in the application of half that amount, or about 4–5 lbs/ream (ream size 3000 $ft^2$).

The applicator system employed by the present invention has the added advantage that when the liquid metering device is not in use, the system performs like a typical water box with a flooded nip providing the web with about the same amount of moisture as a typical waterbox. It is contemplated that the use of the liquid application system of the present invention could be automated to retract and extend the metering device as desired and vary the liquid delivery volume in response to web measurements taken after the calender. It is also contemplated that the liquid application system could be located at other locations on the papermachine, as for example, against a dryer drum or other roll where the roll is at least partially wrapped by the web.

The invention will be better understood by reference to the following example.

EXAMPLE

A paperboard basestock was wetted using a capillary applicator at 1200 fpm, and immediately thereafter passed under a blade to remove excess water before being introduced into a nip between two rolls of a machine calender. At blade loads less than about 5 psi, the nip was flooded, as would be expected from a typical waterbox installation, and the moisture pickup ranged from about 8–10 lbs/ream (ream size 3000 $ft^2$). With blade loads above 10 psi, as little as 3.3 lbs/ream of moisture was applied. Better uniformity was achieved at a pickup of from about 4–5 lbs/ream with blade loads of between 5 and 10 psi. In this Example, a Sheffield roughness of 217.7 was achieved on an uncoated sample at a calender load of 300 pli and blade load of 15 psi, with a caliper of 12.09 mils, while about the same Sheffield roughness (220.1), was achieved at the same load, but with a flooded nip, at a reduced caliper of 11.93 mils. Thus it will be seen that substantially the same finished condition, e.g, Sheffield roughness, can be achieved with either the flooded nip method or the moisture application system of the present invention. However, this finished condition is achieved with the present invention without unduly reducing the caliper or thickness of the paperboard.

In summary, the present invention comprises a method and apparatus for applying moisture to a paper web on the papermachine during the manufacturing process. The moisture application system is especially useful in the finishing of paper, and particularly paperboard, since finished conditions equivalent to those obtained with conventional moisture application means are achieved at lower density and higher caliper. This is an important factor because paperboard is generally sold by area rather than weight.

While the invention has been fully described and disclosed with a preferred embodiment, it will be understood by those skilled in the art that various modifications may be made without departing from the spirit of the invention as defined in the appended claims.

What is claimed is:

1. An apparatus for finishing a web of paper to provide enhanced smoothness with minimal loss of caliper comprising: a calender device including at least two calender rolls arranged in nipped relation through which a paper web is passed, and at least one moisture application system associated with said calender adjacent to the nip between said calender rolls, said moisture application system consisting essentially of a moisture application means which is an array of tubes, spray nozzles, jets or slots, said moisture application means being structured and arranged to apply a film of liquid directly onto the surface of the paper web prior to the web entering the nip when the calender rolls are rotated, and a first metering device arranged to cooperate with the paper web to scrape off excess liquid and control the thickness and uniformity of the liquid film applied to the paper web before the web enters the calender nip; wherein said metering device comprises a metering element that is selected from the group consisting of a blade and a rod.

2. The apparatus of claim 1 wherein the metering device includes a means for adjusting the relationship between the metering element and the paper web.

3. The apparatus of claim 2 wherein the metering element is a blade adjustable to and from the web and angularly with respect to the web.

4. The apparatus of claim 2 wherein the metering element is a rod adjustable to and from the web and angularly with respect to the web.

5. The apparatus of claim 2 wherein the at least two calender rolls are arranged in a vertical stack.

6. The apparatus of claim 5 which includes a second moisture application system, moisture application means, metering device and metering element located adjacent to a second nip between said calender rolls on the opposite side of said calender stack to apply a film of liquid to the opposite side of the paper web before the web enters the second nip of said calender device.

7. The apparatus of claim 1, wherein the metering device may be retracted and extended to vary the liquid delivery volume.

8. The apparatus of claim 1, wherein the moisture application means is an array of capillary tubes.

9. A method of finishing a web of paper in a calender device to provide enhanced smoothness with minimal loss of caliper comprising:

(a) applying a film of liquid directly to the surface of a paper web using a moisture application system consisting essentially of a moisture application means which is an array of tubes, spray nozzles, jets or slots, said moisture application means applying the film of liquid to the paper web before it is passed through one or more nips formed by calender rolls in a calender device, wherein said nips are formed by at least two calender rolls arranged in nipped relation; and (b) metering excess liquid from the surface of the web before it enters the calender nip by contacting the film of liquid on the surface of the web with a metering device to form a thin film of liquid sufficient to cover the entire surface of the web; wherein the metering device comprises a metering element that is selected from the group consisting of a blade and a rod.

10. The method of claim 9, wherein the moisture application means is a capillary applicator.

11. The method of claim 9, wherein the metering element is a blade.

12. The method of claim 11, wherein the liquid applied to the surface of the web is water applied at from about 4 lbs/ream to about 5 lbs/ream, at a blade load ranging from about 5 psi to about 10 psi.

13. The method of claim 9, wherein the metering element is a blade maintained at a blade load of from about 5 psi to about 15 psi.

14. The method of claim 11, further comprising adjusting the operating position of the blade by adjusting the pressure applied to the blade.

* * * * *